United States Patent [19]
Haak
[11] 4,230,974
[45] Oct. 28, 1980

[54] CATHODE RAY TUBE DEFLECTION CIRCUIT HAVING DISPLAY FORMAT SELECTION

[75] Inventor: Gary R. Haak, Park Ridge, Ill.

[73] Assignee: Teletype Corporation, Skokie, Ill.

[21] Appl. No.: 30,256

[22] Filed: Apr. 16, 1979

[51] Int. Cl.[3] ..... H01J 29/70; H01J 29/76
[52] U.S. Cl. ..... 315/399; 340/731
[58] Field of Search ..... 315/399, 395; 340/731, 340/745

[56] References Cited

U.S. PATENT DOCUMENTS

| | | | |
|---|---|---|---|
| 3,559,207 | 1/1971 | Atkinson | 340/154 |
| 3,903,517 | 9/1975 | Hafner | 340/731 |

*Primary Examiner*—Theodore M. Blum
*Attorney, Agent, or Firm*—W. K. Serp; J. C. Albrecht

[57] ABSTRACT

A cathode ray tube deflection circuit is described which selects between two display formats in response to a format control signal. A horizontal deflection portion includes the primary winding of a flyback transformer resonant with a horizontal deflection yoke. Switches are connected across a portion of the primary winding and across portions of the yoke. A logic unit, in response to the control signal, actuates each of the switches to change the resonant frequency of the horizontal deflection circuit. The logic unit correspondingly changes the frequency of the horizontal drive signal and the amplitude of the vertical sweep.

4 Claims, 1 Drawing Figure

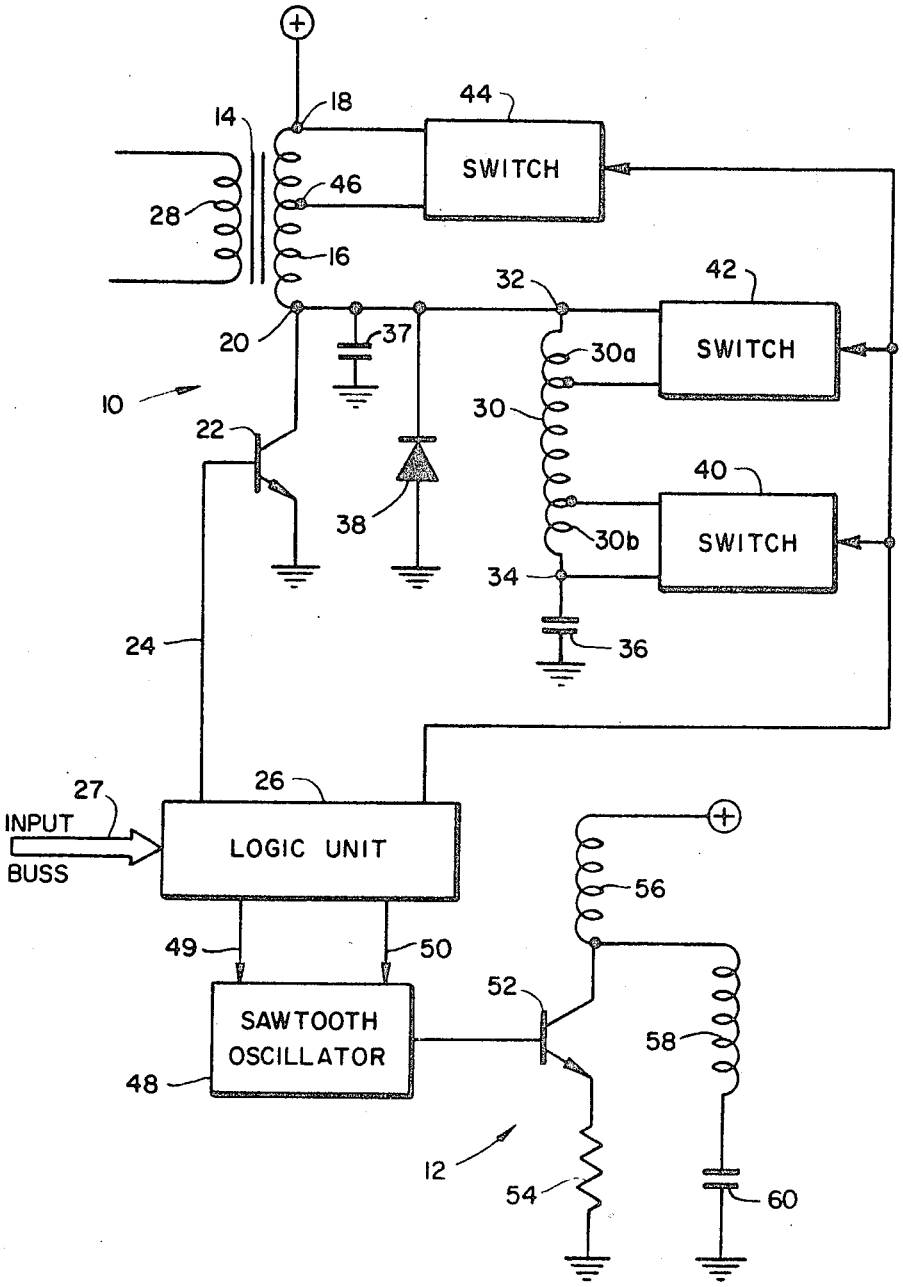
18
44
14
SWITCH
46
28
16
32
42
20
37
30a
SWITCH
10
30
22
40
38
30b
SWITCH
34
24
36
27
26
INPUT
BUSS
LOGIC UNIT
56
49
50
52
SAWTOOTH
OSCILLATOR
58
48
12
54
60

CATHODE RAY TUBE DEFLECTION CIRCUIT HAVING DISPLAY FORMAT SELECTION

DESCRIPTION

TECHNICAL FIELD

This invention relates to a cathode ray tube deflection circuit having selectable display formats.

Display devices such as cathode ray tubes (CRT's) are frequently utilized in communications terminals. Such terminals provide the operator with the display of various types of data. Although one data type may be conveniently displayed in one format, another data type may find optimum display in a different format. For example, alphanumeric text is generally displayed in a format having 24 lines with 80 characters per line; however, numerical listings are more conveniently displayed with 80 lines and 24 characters. Other variations are often provided as necessitated by the operational environment.

BACKGROUND ART

One prior arrangement for providing a selectable format scans the maximum total screen area utilized by the combined formats and displays characters only in the desired portions of the cathode ray tube screen. Such an arrangement results in unnecessary power dissipation since the entire screen of the CRT is scanned while only a portion is utilized. Further, since the maximum screen area is scanned, some of the display time is unused resulting in a reduction in the overall information throughput efficiency. Still another prior arrangement physically rotates the cathode ray tube yoke structure ninety degrees by means of a mechanical coupling thus providing two alternate formats. A major drawback to this configuration is that the yoke positioning mechanism is large and expensive particularly if reasonable positional accuracy is desired. Some commercial products obtain format selection by using linear deflection amplifiers capable of producing a desired display format in either of two orientations. As a result of the voltages utilized and power controlled, the circuitry involved is large and expensive and therefore not economically competitive. The hereinafter described apparatus obtains alternate display format selection by changing the frequency of the horizontal sweep signal so as to produce a change in the number of lines during each raster and changes the amplitude of the vertical sweep signal to correspond to the change in the number of lines in the CRT raster.

DISCLOSURE OF THE INVENTION

A cathode ray tube deflection circuit is illustrated which includes means for changing the display format in response to a control signal. A horizontal deflection circuit includes an inductance having a first inductive value resonated with a capacitor to a first horizontal sweep frequency. Means are provided in the form of a switch for changing the inductive value of the inductance to a second value and for changing the horizontal sweep frequency to correspond to the new resonant frequency.

The deflection circuit includes a vertical deflection portion which includes means responsive to the control signal for adjusting the amplitude of the magnetic output of the vertical sweep circuit from a first value to a second value. In particular, the horizontal deflection circuit inductance includes a yoke defining a plurality of portions with a switch connected across each portion for effectively changing the inductive value of the yoke in response to the control signal.

THE DRAWINGS

FIG. 1 is a schematic diagram of a cathode ray tube deflection circuit including certain features of this invention.

DETAILED DESCRIPTION

Horizontal Deflection

FIG. 1 illustrates the horizontal 10 and vertical 12 deflection circuits for a cathode ray tube (not shown). The horizontal deflection circuit 10 includes a horizontal flyback transformer 14 having a tapped primary winding 16. One end 18 of the primary is connected to the positive terminal of a high voltage supply and the remaining terminal 20 to the collector of an NPN switching transistor 22. The emitter of the transistor 22 is connected to supply ground. The switching transistor 22 serves to interrupt current flow through the primary 16 of the transformer 14 at the horizontal sweep rate and is controlled by a horizontal drive signal applied to the base of the switching transistor 22. The horizontal drive signal is fed from a logic unit 26 which may take the form of a programmed logic array or a microprocessor and is controlled by a control signal on an input buss 27. The flyback transformer 14 includes a secondary winding 28 which provides high voltage alternating current to a high voltage rectification circuit (not shown).

The horizontal deflection circuit 10 additionally includes a cathode ray tube horizontal deflection yoke 30. One terminal 32 of the yoke 30 is connected to the collector of the switching transistor 22 and the remaining terminal 34 is connected to an alternating current coupling capacitor 36 the remaining terminal of which is grounded. In accordance with conventional practice, the yoke 30 is divided in half with the halves positioned on opposite sides of the CRT. The transformer primary inductance 16 and the effective yoke 30 inductance are resonated with a capacitor 37 at the frequency of the horizontal drive signal from the logic unit 26 via the line 24. The capacitor 37 is connected from terminal 20 to ground. It will be appreciated that the inductance of the horizontal deflection circuit 10 must exhibit a high "Q" and be tuned relatively close horizontal sweep frequency to minimize heat dissipation. This feature is obtained by simultaneously changing the inductance of both the primary winding 16 and the yoke 30. Serving to prevent the inductive voltage generated by the primary transformer winding 16 from destroying the switching transistor 22, a diode 38 is connected with its cathode to the collector of the transistor 22 and the anode thereof grounded. Additionally, the diode provides a direct current path for the negative portion of the horizontal sweep signal.

As previously mentioned, the logic unit 26 responds to an incoming format selection control signal fed from the input buss 27. In response to a format selection command on the buss 27, a second higher frequency horizontal drive signal is selected and the logic unit 26 simultaneously activates switches 40, 42 respectively connected across portions **30*a* and 30*b* of the horizontal deflection yoke 30 and a switch 44 connected to the primary winding 16 of the flyback transformer 14. The electronic switch 44 is connected between the positive terminal 18 of the flyback transformer 14 primary winding 16 and a tap 46 on the primary winding 16. When the switch 44** is open, the full primary winding inductance is in the circuit and when shorted only a portion of the total inductance is effective.

The horizontal deflection yoke 16 is divided into two halves with the halves being positioned at opposite sides of the CRT. The first horizontal yoke switch 40 is connected to selectively short the first portion 30*b* of the horizontal yoke 30 and the second switch 42 is connected to selectively short the second portion 30*a* of the yoke 30. In this manner, the inductance of the yoke placed at one side of the CRT is maintained equal to the inductance of the other half positioned at the opposite side of the CRT. Thus, horizontal centering of the display raster on the face of the CRT is retained when switching between display formats. All three switches 40, 42 and 44 are activated simultaneously. It has been found that a reduction in the inductance of the primary winding 16 along with a corresponding reduction in the yoke 30 inductance assures a reasonable circuit "Q" and thus maintains high circuit efficiency. It will be appreciated that when the switches are closed, the effective number of winding turns generating the magnetic deflection field is reduced and since the strength of the magnetic field is proportional to the number of inductive turns multiplied by the current passing therethrough, the horizontal width of the CRT raster will correspondingly be reduced.

Vertical Deflection Circuit

The logic unit 26 also controls the amplitude of the vertical deflection circuit 12 and provides a vertical synchronization signal via line 49 to a vertical sawtooth oscillator 48. The oscillator 48 generates a sawtooth wave which is synchronized to a vertical synchronization signal. The amplitude of the oscillator signal is controlled by the logic unit 26 by a signal via line 50 in response to a format selection control signal on the input buss 27. Additionally, the vertical deflection circuit 12 includes a vertical drive NPN transistor 52 biased by an emitter resistor 54 into linear class "A" operation. The collector of the transistor 52 is connected to the positive terminal of the supply source through decoupling choke 56 and to a vertical deflection yoke 58 positioned at the CRT. Serving to allow full positive and negative swings of the current through the vertical yoke 58, is a coupling capacitor 60 connected between are terminal of the yoke 58 and ground. It will be appreciated that both the horizontal 30 and vertical 58 deflection yokes are A.C. coupled and therefore the CRT raster is self-centering. For a further discussion of CRT deflection circuits the reader's attention is directed to pages 134 to 140 of the "RCA Transistor, Thyristor & Diode Manual" 1969.

Operation

For discussional purposes it is assumed that the switches 40, 42 and 44 are open and thus the horizontal deflection circuit 10 has maximum inductance. In this condition, current flows through the greatest number of turns producing the maximum horizontal magnetic deflection of the CRT beam. Under such conditions, the magnitude of the vertical drive amplitude from the logic unit 26 via line 50 is relatively low. This arrangement provides a display format which is relatively wide and with a relatively low vertical height. Such a display would be suitable for a presentation of twenty-four lines each having eighty characters.

In response to a format control signal on the input buss 27, the logic unit closes the switches 40, 42 and 44 and increases the horizontal drive frequency via line 24. Since the number of turns in the primary winding 16 and yoke 30 have been reduced, the magnetic flux decreases and the width of the CRT raster decreases. Further, in response to the format control signal, the vertical amplitude of the vertical sweep is increased producing a corresponding increase in the vertical height of the CRT raster. The CRT raster now displays a format suitable for displaying 80 lines of 24 characters.

While one specific embodiment of the invention has been described in detail, it will be obvious that various modifications may be made without departing from the spirit and scope of the invention.

What is claimed is:

1. An apparatus for selectively changing the display on the screen of a cathode ray tube from a first format to a second format in response to a format control signal including a horizontal deflection circuit 10 having an inductance 16, 30 with a first inductive value resonated with a capacitor 37 to a first horizontal sweep frequency, means 26 for generating a horizontal drive signal 24 in response to the format selection signal for driving the horizontal deflection circuit 10, the horizontal deflection circuit 20 determining the horizontal size of the display, means 26, 40, 42, 44, responsive to the control signal 27, for changing the inductive value of said inductance 16, 30 to a second value and thus changing the resonant frequency of the horizontal deflection circuit to a second value, means 26 responsive to the control signal 27, for changing the frequency of said horizontal drive signal to a second frequency related to the second resonant frequency of the horizontal deflection circuit 10, and a vertical deflection circuit 12 including means 26 responsive to the format control signal for varying the amplitude of the output of the vertical deflection circuit from a first value to a second value CHARACTERIZED BY:

said horizontal deflection circuit inductance 16, 30 including a yoke 30 and said inductive value changing means 26, 40, 42, 44 including a switch 40, 42 for effectively shorting at least a portion of the turns of said yoke 30 so as to reduce the inductance of the yoke 30.

2. The apparatus of claim 1 further characterized by said horizontal deflection circuit 10 including a flyback transformer 14 having a primary winding 16 and said inductive value charging means 26, 40, 42, 44 including a switch 44 connected across a portion of said primary winding 16 for shorting a portion of said primary winding 16 thereby changing the inductive value of the primary winding 16 in response to the format control signal 27.

3. The apparatus of claim 2 further characterized by said horizontal deflection yoke 30 defines a plurality of portions 30*a* and 30*b* and with a switch 40, 42 connected across each portion of the yoke winding for effectively changing the inductive value of the yoke in response to said control signal 27.

4. The apparatus of claim 3 further characterized by said primary winding 16 and said yoke 30 are series resonant with a capacitor 36 at the frequency of said horizontal drive signal 24.

* * * * *